US009095952B2

(12) United States Patent
Benvegnu et al.

(10) Patent No.: US 9,095,952 B2
(45) Date of Patent: Aug. 4, 2015

(54) REFLECTIVITY MEASUREMENTS DURING POLISHING USING A CAMERA

(71) Applicant: Applied Materials, Inc., Santa Clara, CA (US)

(72) Inventors: Dominic J. Benvegnu, La Honda, CA (US); Boguslaw A. Swedek, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 145 days.

(21) Appl. No.: 13/794,365

(22) Filed: Mar. 11, 2013

(65) Prior Publication Data

US 2014/0206259 A1 Jul. 24, 2014

Related U.S. Application Data

(60) Provisional application No. 61/755,874, filed on Jan. 23, 2013.

(51) Int. Cl.

| | |
|---|---|
| ***G01N 21/00*** | (2006.01) |
| ***B24B 37/013*** | (2012.01) |
| ***B24B 49/12*** | (2006.01) |

(52) U.S. Cl.

CPC ..... *B24B 37/013* (2013.01); *B24B 49/12* (2013.01)

(58) Field of Classification Search

CPC ..... G01B 2290/70; G01B 9/0209; G01B 9/02057; G01B 9/0201; G01B 11/0675; G01B 2290/50; G01B 2290/45; G01B 9/02007; G01B 9/02027; G01B 9/02084; G01B 9/02088; G01B 11/2441; G01B 9/02039; G01B 9/00

See application file for complete search history.

(56) References Cited

U.S. PATENT DOCUMENTS

| | | | | |
|---|---|---|---|---|
| 5,738,574 | A | 4/1998 | Tolles et al. | |
| 6,106,662 | A * | 8/2000 | Bibby et al. | 156/345.13 |
| 6,142,855 | A | 11/2000 | Nyui et al. | |
| 6,361,646 | B1 * | 3/2002 | Bibby et al. | 156/345.1 |
| 6,466,642 | B1 * | 10/2002 | Meloni | 378/44 |
| 7,008,295 | B2 | 3/2006 | Wiswesser et al. | |
| 8,292,693 | B2 | 10/2012 | David et al. | |
| 2004/0080757 | A1 * | 4/2004 | Stanke et al. | 356/601 |
| 2004/0259472 | A1 | 12/2004 | Chalmers et al. | |
| 2006/0061746 | A1 | 3/2006 | Kok et al. | |
| 2007/0077671 | A1 | 4/2007 | David et al. | |
| 2009/0014409 | A1 * | 1/2009 | Grimbergen | 216/12 |
| 2012/0026492 | A1 | 2/2012 | Zhang et al. | |

FOREIGN PATENT DOCUMENTS

| | | |
|---|---|---|
| JP | 2001-345299 | 12/2001 |
| WO | 2011/094706 | 8/2011 |

OTHER PUBLICATIONS

International Search Report and Written Opinion in International Application No. PCT/US2014/012558, mailed May 20, 2014, 12 pages.

* cited by examiner

*Primary Examiner* — Michael P Stafira
(74) *Attorney, Agent, or Firm* — Fish & Richardson P.C.

(57) ABSTRACT

A substrate polishing system includes a platen to support a polishing surface, a carrier head configured to hold a substrate against the polishing surface during polishing, a light source configured to direct a light beam onto a surface of the substrate, a detector including an array of detection elements, and a controller. The detector is configured to detect reflections of the light beam from an area of the surface, and is configured to generate an image having pixels representing regions on the substrate having a length less than 0.1 mm. The controller is configured to receive the image and to detect clearance of a metal layer from an underlying layer on the substrate based on the image.

18 Claims, 3 Drawing Sheets

REFLECTIVITY MEASUREMENTS DURING POLISHING USING A CAMERA

CROSS-REFERENCE TO RELATED APPLICATIONS

This application claims priority to U.S. Provisional Application Ser. No. 61/755,874, filed Jan. 23, 2013, the entire disclosure of which is incorporated by reference.

TECHNICAL FIELD

This invention generally relates to optically monitoring a substrate during chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

Variations in the slurry distribution, the polishing pad condition, the relative speed between the polishing pad and the substrate, and the load on the substrate can cause variations in the material removal rate. These variations, as well as variations in the initial thickness of the layer being polished, cause variations in the time needed to reach the polishing endpoint. Therefore, determining the polishing endpoint merely as a function of polishing time can lead to overpolishing or underpolishing of the substrate. Various in-situ monitoring techniques, such as optical or eddy current monitoring, can be used to detect a polishing endpoint.

One problem in CMP is conductive residue. For example, in the production of conductive vias, plugs and lines, the conductive filler layer should be polished until it is completely removed from the top surface of the underlying patterned layer. Otherwise, any conductive residue that remains can cause shorts or other defects. One technique to prevent residue is to overpolish the substrate, e.g., to continue polish past a detected polishing endpoint.

SUMMARY

In general, in one aspect, a substrate polishing system includes a platen to support a polishing surface, a carrier head configured to hold a substrate against the polishing surface during polishing, a light source configured to direct a light beam onto a surface of the substrate, a detector including an array of detection elements, and a controller. The detector is configured to detect reflections of the light beam from an area of the surface, and is configured to generate an image having pixels representing regions on the substrate having a length less than 0.1 mm. The controller is configured to receive the image and to detect clearance of a metal layer from an underlying layer on the substrate based on the image.

Implementations may include one or more of the following features. The detector may be a linescan camera. The detector may be configured such that the image has pixels representing regions on the substrate having a width less than 0.1 mm. The area may be between 2 and 30 mm long. The detector may include at least 1024 detection elements. The detector may be configured to operate at a frame rate at least 5 kHz. A mirror may to reflect the light beam. The mirror may be positioned at a point in the optical path between the substrate and the detector. The light source may be configured such that the light beam is directed toward the substrate at a non-zero angle $\alpha$ from an axis normal to a surface of the substrate. The angle $\alpha$ is between 20 and 30°.

Implementations may optionally include one or more of the following advantages. Control of the chemical mechanical process can be improved. A polishing endpoint can be detected more accurately, and control over polishing rates at different regions of the substrate can be performed. Metal clearing can be performed with improved within-wafer and within-die uniformity.

The details of one or more implementations are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

In some semiconductor chip fabrication processes, an overlying filler layer, for example, a conductive material, e.g., a metal, such copper or tungsten, is polished until an underlying layer of a different material, e.g., a dielectric, such as silicon oxide, silicon nitride or a high-K dielectric, is exposed. It can be desirable to ensure that no residue remains on the patterned underlying layer. Some polishing systems include an optical monitoring system that illuminates a spot and measures the reflectivity of or spectrum of reflected light from the spot. However, residue can occur in regions smaller than the spot size, and if the spot size is decreased, then a larger portion of the substrate is not monitored. A technique which can address this issue, but could be used for other reasons, is to monitor the substrate with a camera.

Figure 1:
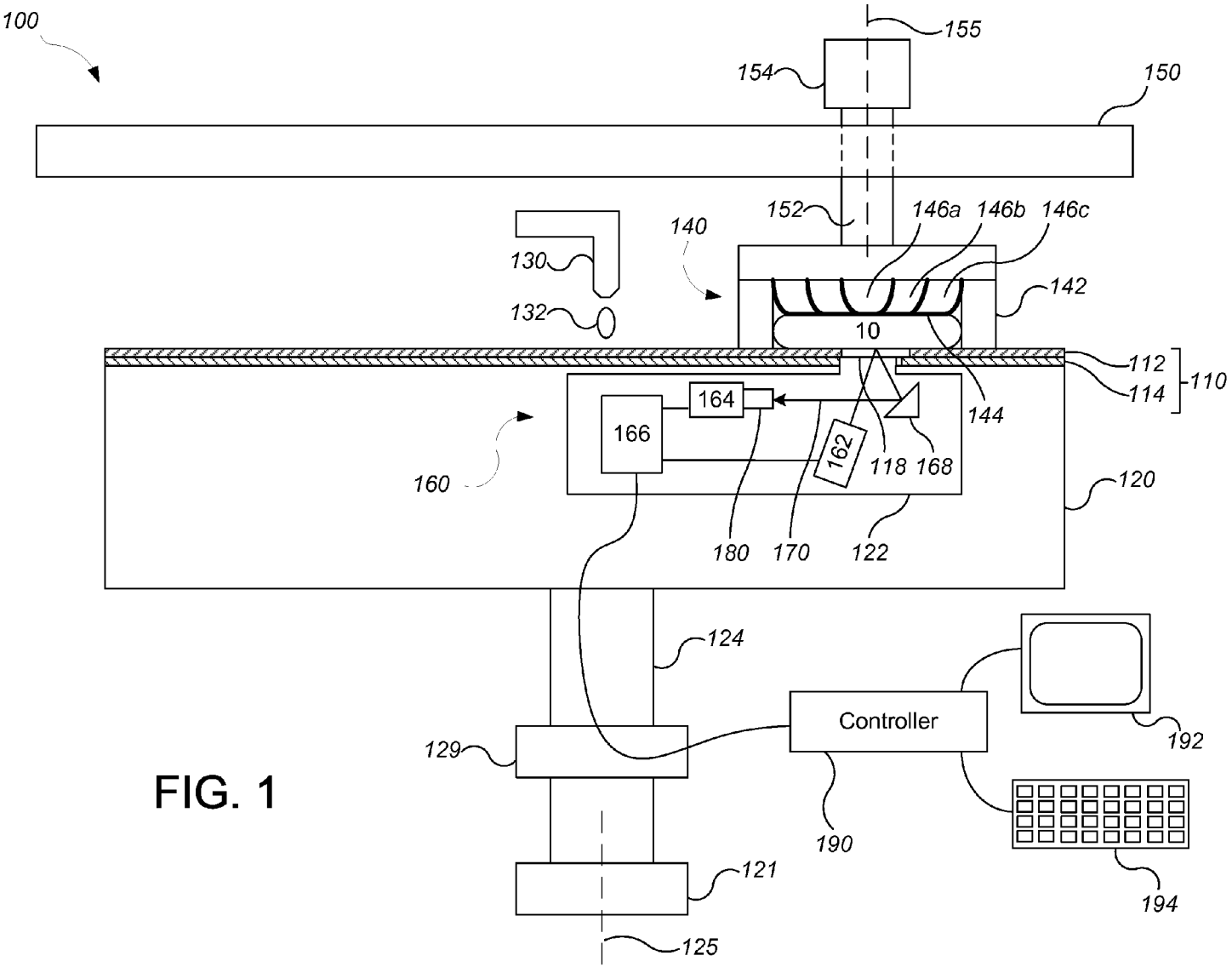
FIG. 1 is a schematic cross-sectional side view of a chemical mechanical polishing (CMP) apparatus including an optical monitoring system.

Referring to FIG. 1, a substrate 10 is polished by a chemical mechanical polishing (CMP) apparatus 100. Descriptions of similar polishing apparatus may be found in U.S. Pat. No.

5,738,574 and U.S. Pat. No. 8,292,693, the entire disclosures of which are incorporated herein by reference.

The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. For most polishing processes, the platen drive motor 121 rotates the platen 120 at thirty to two hundred revolutions per minute, e.g., about 60 to 100 rpm, although lower or higher rotational speeds may be used.

The polishing pad 110 can be a two-layer polishing pad with an outer polishing layer 112 and a softer backing layer 114.

The polishing apparatus 100 can include a port 130 to dispense polishing liquid 132, such as slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. The carrier head 140 can have independent control of the polishing parameters, for example pressure, associated with each respective substrate. In particular, the carrier head 140 can include a retaining ring 142 to retain the substrate 10 below a flexible membrane 144. The carrier head 140 also includes a plurality of independently controllable pressurizable chambers defined by the membrane, e.g., three chambers 146*a*-146*c*, which can apply independently controllable pressures to associated zones on the flexible membrane 144 and thus on the substrate 10. Although only three chambers are illustrated in FIG. 1 for ease of illustration, there could be one or two chambers, or four or more chambers, e.g., five chambers.

The carrier head 140 is suspended from a support structure 150, e.g., a carousel or track, and is connected by a drive shaft 152 to a carrier head rotation motor 154 so that the carrier head can rotate about an axis 155. Optionally the carrier head 140 can oscillate laterally, e.g., on sliders on the carousel 150; by rotational oscillation of the carousel itself, or by motion along the track. In operation, the platen is rotated about its central axis 125, and the carrier head is rotated about its central axis 155 and translated laterally across the top surface of the polishing pad. While only one carrier head 140 is shown, more carrier heads can be provided to polish multiple substrates simultaneously with the same polishing pad.

The polishing apparatus also includes an in-situ optical monitoring system 160. The optical monitoring system 160 images a field of view 174 (see FIG. 2) that sweeps across the substrate 10. The field of view is narrower than the substrate, but can be wider than a die on the substrate (the die can be in the process of being fabricated). The camera images the field of view to generate an image with pixels that represent regions at most 0.1 mm wide on the substrate.

In order to perform monitoring of the substrate 10, an optical access through the polishing pad 110 can be provided by including an aperture (i.e., a hole that runs through the pad) or a solid window 118. The solid window 118 can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a controller 190 and the light source 162 and light detector 164. In operation, the light source generates a light beam 170, and a reflection of the light beam 170 from the substrate is directed to the detector 164.

The light source 162 and detector 164 can be secured to the platen 120 and rotate with the platen 120. For example, the light source 162 and detector 164 can be installed in a module 122 that is removably installable in the platen 120. The light source 162 illuminates a region on the substrate 10 that covers at least the field of view 174 of the detector 164 on the substrate 10.

Figure 2:
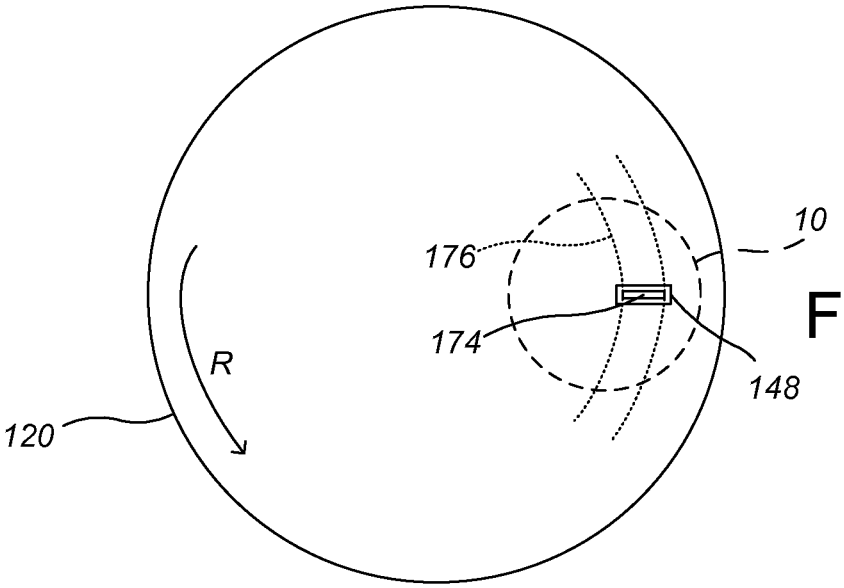
FIG. 2 is a schematic top view of the polishing apparatus.

As the platen 120 rotates, the field of view 174 (see FIG. 2) illuminated by the light beam 170 sweeps across the substrate 10 in a path 176 (see FIG. 2). This generates one sweep of the field of view across the substrate per rotation of the platen 120. However, other arrangements are possible to generate a field of view that sweeps across the substrate. For example, the detector and/or the light source could be located outside the platen, and the light beam could be transmitted through a rotary optical coupling to and/or from optical elements, e.g., mirrors or optical fibers, that rotate with the platen and direct the light beam to and/or from the substrate.

In some implementations, the optical monitoring system includes a mirror 168, and the light beam is reflected from the mirror at a point in the optical path either before or after reflection from the substrate 10. An advantage of a mirror is that it can permit one or more components, e.g., the detector 164, to be oriented horizontally, thus reducing the total height of the components that need to secured to the platen 120, and permitting the optical monitoring system 160 to be used in a polishing apparatus where vertical space is limited.

In some implementations, a beam expander (not illustrated) may be positioned in the path of the light beam to expand the light beam along an axis to generate an elongated illuminated spot on the substrate. In some implementations, the beam is expanded along an axis that is perpendicular to the instantaneous direction of motion of the illuminated spot caused by the rotation of the rotation of the platen 120. If the illuminated spot is elongated, the window 118 can be similarly elongated.

In some implementations the light beam impinges the substrate at an angle off the normal axis to the surface of substrate 10. For example, the light beam can be directed toward the window 118 at an angle $\alpha$ from an axis normal to the surface of substrate 10, e.g., at an angle $\alpha$ from axes 25 and 81. The angle $\alpha$ can be selected to provide improved contrast between the overlying layer and the underlying layer, e.g., improved contrast between a copper layer an underlying barrier layer or dielectric layer. For example, the angle $\alpha$ can be between 0 and 80°, e.g., between 20 and 30°. An angle $\alpha$ between 20 and 30° can provide good discrimination of copper from an underlying dielectric.

The light source 162 can be operable to emit broadband light or monochromatic light. The light from the light source can be in the range from ultraviolet (UV) to near infrared (NIR), i.e., in the range of 200 nm to 2.0 um. For example, the wavelength can be in the range of 800 to 830 nm, e.g., 810 nm, which is slightly into the infrared. A wavelength in the range of 800 to 830 nm can provide good discrimination of copper from an underlying dielectric. The light source should provide incoherent light; a monochromatic laser source can be too coherent and lead to interference fringes in the image. A suitable monochromatic light source is a monochromatic LED assembly. In some implementations, the light source generates white light, e.g., light having wavelengths of 200-800 nanometers. A suitable white light source is a xenon lamp or a xenon mercury lamp.

Referring to FIG. 2, the illuminated spot sweeps across the substrate 10 in a path 176. For example, as noted above, rotation (shown by arrow R) of the platen 120 carries the window 148 and the illuminated spot along the path 176. The light source and beam expander (if present) are configured such that the illuminated spot 174 is narrower than the substrate 10, but can be wider than a die on the substrate 10. In some implementations, the illuminated spot is between 5 and 25 mm long. The illuminated spot can be about 5 to 10 mm wide.

Figure 3:
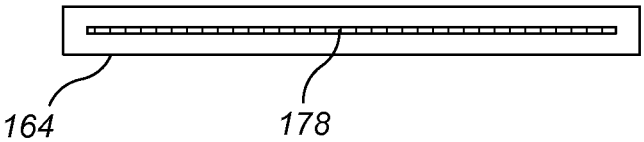
FIG. 3 is a schematic view of a detector.

Referring to FIG. 3, the detector 164 is a camera that is sensitive to light from the light source 162. The camera includes an array of detector elements 178. For example, the camera can include a CCD array. In some implementations, the array is a single row of detector elements. For example, the camera can be a linescan camera. For example, a row of detector elements can include 1024 or more elements.

The camera 164 is configured with appropriate focusing optics 180 to project a field of view of the substrate onto the array of detector elements 178. The field of view can be 2 mm to 30 mm long. The camera 164, including associated optics 180, can be configured such that individual pixels correspond to a region having a length equal to or less than about 0.1 mm. For example, assuming that the field of view is about 10 mm long and the detector 164 includes 1024 elements, then an image generated by the linescan camera can have pixels with a length of about 0.1 mm. To determine the length resolution of the image, the length of the field of view (FOV) can be divided by the number of pixels onto which the FOV is imaged to arrive at a length resolution. For example, 2 mm FOV divided by 1024 pixels gives approximately 2 um length resolution. A 30 mm divided by 1024 pixels gives 30 um per pixel.

The camera 164 can be also be configured such that the pixel width is comparable to the pixel length. For example, an advantage of a linescan camera is its very fast frame rate. The frame rate can be at least 5 kHz. The frame rate can be set at a sufficiently high frequency that the pixel width is comparable to the pixel length, e.g., equal to or less than about 0.1 mm. To determine the width resolution of the image, the length of the path traversed by the field of view in a single rotation of the platen can be multiplied by the platen rotation rate and divided by the camera frame rate. For example, for a window centered about 8 inches from the axis of rotation 125 and a platen rotation rate of 90 rpm, a frame rate of about 13 kHz can provide a pixel width of about 0.1 mm.

By using a detector with a larger number of detector elements, imaging a narrower field of view and/or using a higher frame rate, the image can be even higher resolution. For example, the frame rate can be 30-50 kHz, in order to increase the width resolution of the image.

The intensity of light detected at detector 164 depends on, e.g., the composition of the substrate surface, substrate surface smoothness, and/or the amount of interference between light reflected from different interfaces of one or more layers (e.g., dielectric layers) on the substrate.

As noted above, the light source 162 and light detector 164 can be connected to a computing device, e.g., the controller 190, operable to control their operation and receive their signals. The computing device can include a microprocessor situated near the polishing apparatus. For example, the computing device can be a programmable computer.

Figure 4:
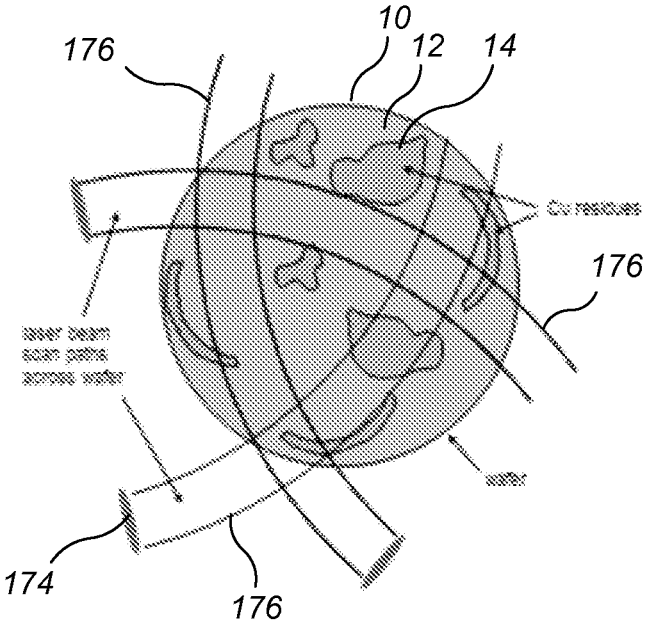
FIG. 4 is a schematic view of paths of a field of view across a substrate.

Referring to FIG. 4, the field of view 174 will make multiple sweeps 176 across the substrate 10. Assuming that an overlying filler layer is being polished until an underlying layer of a different material is being exposed, e.g., polishing of copper to expose an underlying dielectric, near to the polishing endpoint there will some regions of the substrate in which the underlying layer 12 is completely exposed, and some regions that remained covered by residue 14 of the filler layer. Assuming the wavelength and angle of incidence are properly selected, there will be significant reflectivity difference between residue of the filler layer and exposed regions of the underlying layer. In general, regions with copper residue will have a higher reflectivity than regions in which the copper has been removed and the underlying dielectric layer has been exposed.

Figure 5:
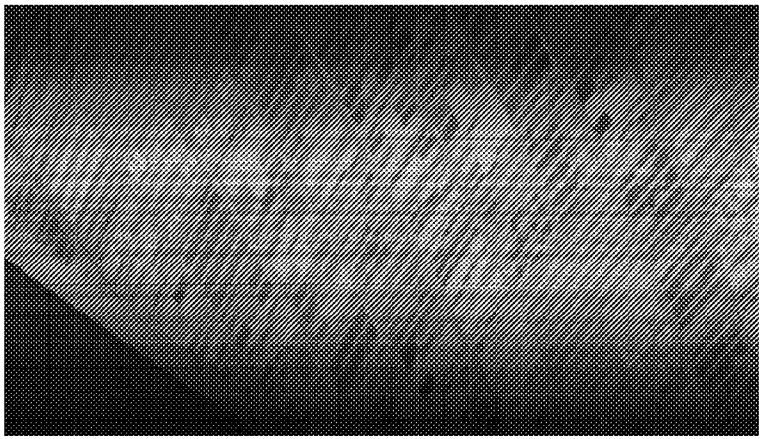
FIG. 5 is an example of an image taken from a bench system.

FIG. 5 illustrates an image of a patterned wafer generated by a linescan camera. The image was obtained on a bench system. The horizontal axis of the image corresponds to different detector elements in the array, and the vertical axis of the image corresponds to time. The vertical streaks in the image are distortions due to the pad window. These distortions can be removed by filtering, e.g., background normalization. As shown in the image, resolution of the image is sufficient to detect regions of high or low density within individual dies on the substrate.

Figure 6:
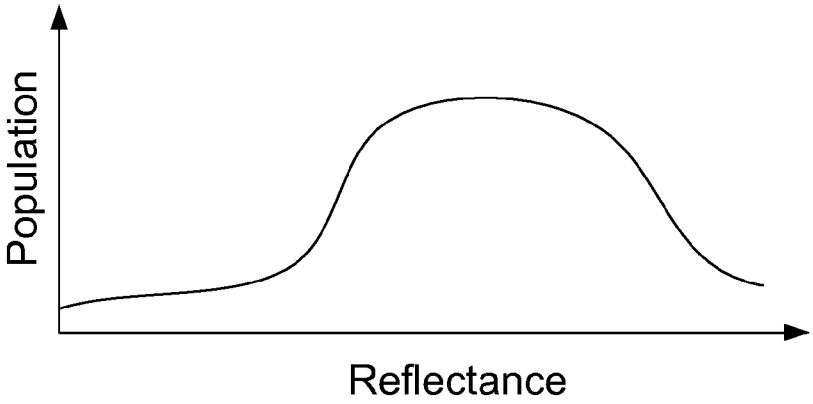
FIG. 6 is an example of a histogram.

Using appropriate image analysis, the material of interest, e.g., copper, can be identified and quantified. For example, the fraction of the overall area that remains covered by the material of interest can be determined. As another example, details about where the material of interest occurs within the substrate pattern or within the die can be determined. As another example, a histogram of the pixel values can be generated. Evolution of the histogram could be analyzed. An example of a histogram is shown in FIG. 6; the histogram shows the distribution of pixel intensity. More complicated types of image analysis, such as pattern recognition or intensity modeling, can be performed.

The images obtained and corresponding image analysis can be used for endpoint detection, profile control and closed loop control either in situ or in run-to-run operation.

In some implementations, data can be used for endpoint detection. The endpoint refers to the stage at which the polishing has sufficiently removed the unwanted material from the substrate surface. This can be characterized by a change in reflected intensity from a region of interest, as the material being removed may be more or less reflective than the underlying material.

In general, data can be used to control one or more operation parameters of the CMP apparatus. Operational parameters include, for example, platen rotational velocity, substrate rotational velocity, the polishing path of the substrate, the substrate speed across the plate, the pressure exerted on the substrate, slurry composition, slurry flow rate, and temperature at the substrate surface. Operational parameters can be controlled real-time, and can be automatically adjusted without the need for further human intervention.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers.

Particular embodiments of the invention have been described. Other embodiments are within the scope of the following claims.

What is claimed is:

1. A substrate polishing system, comprising:

a platen to support a polishing surface;

a carrier head configured to hold a substrate against the polishing surface during polishing;

a light source configured to direct a light beam onto a surface of the substrate;

a detector including an array of detection elements, wherein the detector is configured to detect reflections of the light beam from an area of the surface of the substrate with different detection elements receiving light from different portions of the area, and wherein the detector is configured to generate an image of the area of the substrate having pixels representing different regions on the substrate; and a controller configured to receive the image, to generate a histogram of population of intensity values of the pixels of the image, and to detect clearance of a metal layer from an underlying layer on the substrate based on a change in the histogram.

2. The polishing system of claim 1, wherein the detector comprises a linescan camera.

3. The polishing system of claim 2, wherein the detector is configured such that the image has pixels representing regions on the substrate having a width less than 0.1 mm.

4. The polishing system of claim 1, wherein the area is between 5 and 25 mm long.

5. The polishing system of claim 1, wherein the detector comprises at least 1024 detection elements.

6. The polishing system of claim 5, wherein the detector is configured to operate at a frame rate at least 5 kHz.

7. The polishing system of claim 1, comprising a mirror to reflect the light beam.

8. The polishing system of claim 7, wherein the mirror is positioned at a point in the optical path between the substrate and the detector.

9. The polishing system of claim 1, wherein the light source is configured such that the light beam is directed toward the substrate at a non-zero angle $\alpha$ from an axis normal to the surface of the substrate.

10. The polishing system of claim 9, wherein the angle $\alpha$ is between 20 and 30°.

11. A method of monitoring polishing, comprising:

polishing a surface of a substrate;

during polishing, optically monitoring reflections of a light beam from an area of the surface with a detector that includes an array of detection elements with different detection elements receiving light from different portions of the area to generate an image of the area of the substrate having a plurality of pixels representing regions on the substrate;

generating a histogram of population of intensity values of the plurality of pixels of the image; and detecting a change in the histogram and determining a polishing endpoint based on the change.

12. The method of claim 11, wherein the plurality of pixels represent regions on the substrate having a length less than 0.1 mm.

13. The method of claim 11, wherein optically monitoring comprises monitoring with a linescan camera.

14. The method of claim 13, wherein a frame rate of the linescan camera is such that the pixels represent regions on the substrate having a width less than 0.1 mm.

15. The method of claim 11, comprising directing the light beam toward the substrate at a non-zero angle $\alpha$ from an axis normal to the surface of the substrate.

16. The method of claim 15, wherein the angle $\alpha$ is between 20 and 30°.

17. The polishing system of claim 1, wherein the detector is configured such that the pixels represent different regions on the substrate having a length less than 0.1 mm.

18. A computer program product, tangibly embodied in a non-transitory computer readable medium, comprising instructions to cause a processor to:

during polishing of a substrate, receive an image of an area of the substrate, the image having a plurality of pixels representing regions on the substrate;

generate a histogram of population of intensity values of the plurality of pixels of the image; and detect a change in the histogram and determine a polishing endpoint based on the change.

* * * * *